United States Patent [19]

Dubiel et al.

[11] 4,418,590

[45] Dec. 6, 1983

[54] SCREW ASSEMBLY WITH TORQUE DETERMINATION

[75] Inventors: Oswald Dubiel, Neunkirchen-S.; Karl R. Hirtsiefer, Neunkirchen, both of Fed. Rep. of Germany; Johann Müller, deceased, late of Much, Fed. Rep. of Germany; by Christine Müller, executrix, Much-Nebhoven, Fed. Rep. of Germany

[73] Assignee: Paul-Heinz Wagner, Much-Birrenbachschöhe, Fed. Rep. of Germany

[21] Appl. No.: 274,455

[22] Filed: Jun. 17, 1981

[30] Foreign Application Priority Data

Jun. 20, 1980 [DE] Fed. Rep. of Germany ..... 3023005

[51] Int. Cl.[3] ..... B25B 23/14

[52] U.S. Cl. ..... 81/467

[58] Field of Search ..... 81/429, 467, 477, 469, 81/470; 173/12; 73/862.23, 862.29

[56] References Cited

U.S. PATENT DOCUMENTS

| | | | |
|---|---|---|---|
| 1,386,455 | 8/1921 | Clemens | 81/469 |
| 1,970,179 | 8/1934 | Miller | 81/469 |
| 2,893,278 | 7/1959 | Rice | 81/470 |
| 3,710,874 | 1/1973 | Seccombe et al. | 73/862.29 |
| 3,845,673 | 11/1974 | Karden et al. | 81/470 |

*Primary Examiner*—James L. Jones, Jr.

*Attorney, Agent, or Firm*—Diller, Ramik & Wight

[57] ABSTRACT

The screw assembly comprises a drive unit whose output shaft (14) can be connected with a button die to be applied to a screw head.

To prevent the casing (10) of the drive unit from rotating, it is fitted with a retainer (24) which is placed against a solid abutment.

The retainer (24) has a ring (23) enclosing the output shaft and being connected via a torsionally elastic element (16) with the casing (10).

Torsional deformation of the torsionally elastic element (16) is used as a measure for the torque acting on the screw head. (FIG. 1).

19 Claims, 7 Drawing Figures

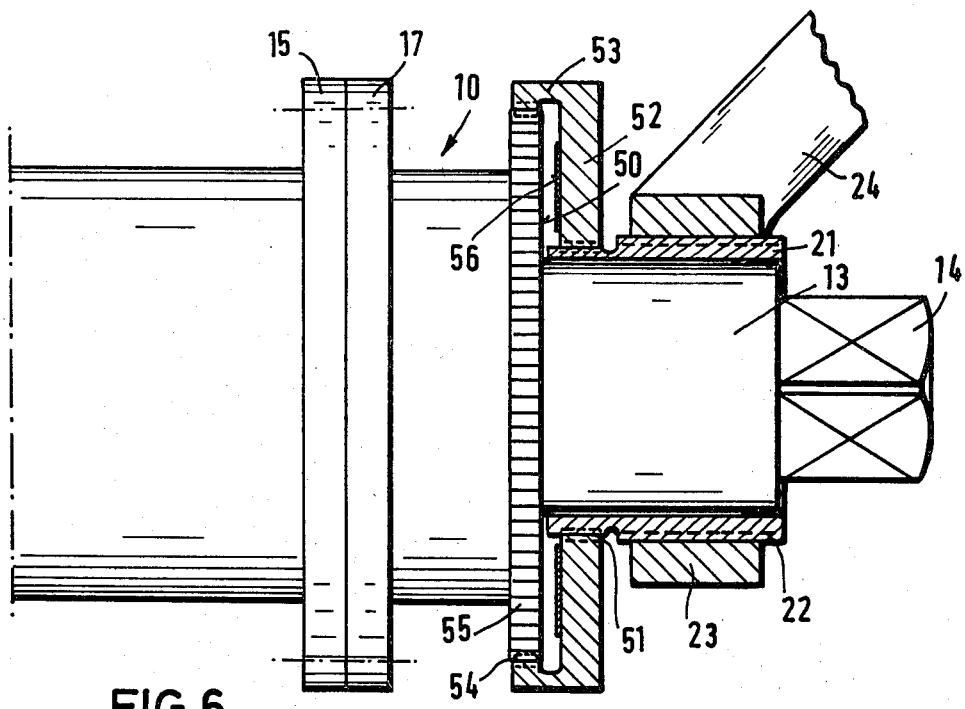
FIG.6
FIG.7
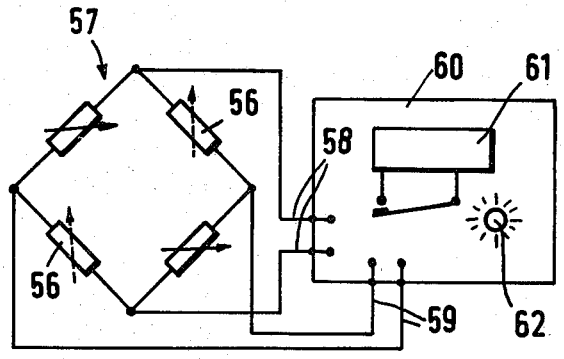

SCREW ASSEMBLY WITH TORQUE DETERMINATION

The invention relates to a screw assembly with torque determination comprising a drive unit arranged in a casing and whose output shaft projects out of the casing, a retainer coupled via an elastic connecting means to the casing and movable longitudinally along a sleeve having a non-round profile, to fix the casing against rotation and a device to determine the torque by measuring the moment of support acting on the retainer.

It has been known to use for the tightening of screws screw means which are provided with an electric, hydraulic or pneumatic drive. Upon the application to a screw to be rotated, the drive means is turned on. If the screw is tightened with the required torque, an indication via a torque limiter and a disconnection of the drive unit resp. are performed automatically.

In a known screw means (DE-A No. 25 20 250) the casing of the drive unit has an extension at which a retainer is conducted to be displaceable in longitudinal direction, but to be non-rotary. The retainer is bipartite and consists of a tube rotatingly mounted integral with the extension and of a casing supported pivotally on the tube. The arm projecting from the tube acts on a dynamometer secured to the casing and comprising an indicating device. If a force is acting on the retainer, the tube in the casing is moved and the corresponding force is shown in the indicating device. The known screw assembly is disadvantageous in that the construction of the retainer is bipartite, and that both elements of the retainer have to be supported coaxially relative to each other. As a result of the friction loss in the pivot bearings and of jamming and tilting, the indicated torque may be adulterated. Moreover, the retainer must have a projecting arm to mount the dynamometer. The dimensions of the resultant assembly are relatively large in radial direction thus restricting the possible use of the screw means.

In a screw machine for the fixing of railway rails (DE-C No. 26 37 954) the casing is so mounted at a stationary supporting system that no retainer does exist. A torque measuring system is incorporated in the screw spindle of the screw machine. The torque measuring system contains a torsionally elastic intermediate piece the one end of which is mounted to the screw spindle and its other end is mounted to a drive flange. In such a device, the torque can be only determined in arrest position, because the entire torque measuring unit is rotating with the screw spindle. Hence, the measuring of the torque can be only realised when due to a release clutch connected ahead, disengaging is effected. Reading is more difficult because upon the standstill of the screw spindle, it is necessary to find the point showing the mark for reading the torque.

There is the basic possibility with hydraulic and pneumatic power wrenches to measure the pressure of the working medium in the pressure line leading to the drive unit and to use it for the determination of the torque. Tests have shown, that this pressure is subjected to periodic time changes thus making it impossible to use the pressure evaluation for the determination of the torque without involved additional means.

It is the object of the invention to provide a screw assembly of the kind mentioned at the outset hereof in which the constructional element initiating the torque limitation is arranged at the output of the wrench, i.e. in the direct vicinity of the screw, thus not requiring to engage the output shaft of the drive unit transmitting the screwing force.

To solve the problem, it is provided according to the invention that the connecting means is a torsionally elastic member enclosing the output shaft and having one end mouned antirotatingly with respect to the casing, while its other end is mounted antirotatingly with respect to the sleeve.

Basically, the reaction force acting on the support leg is utilized to determine the torque, yet the deformable constructional element is not mounted at the support leg but encloses coaxially the output shaft of the power wrench. The torsionally elastic connecting member is increasingly twisted during the screwing operation with increased screw moment, and a switch may be actuated if a specific amplitude of deformation has been reached. Weight and size of the power wrench are increased but only unessentially accordingly. A favorable adaptation of the connecting member shape to the casing shape is realised because the torsionally elastic connecting member surrounds the output shaft or part of the casing at a slight distance only, thus bringing about no essential increase in volume of the power wrench due to the torque limiter.

The twistable (torsionally elastic) member may be a tube member whose one end is fixed to the casing, while its other end is rotated by the retainer. The torsional movement between the two ends of the tube member are used as a measure for the applied torque.

On the tube portion, strain gauges may be fitted which determine the deformation of the tube portion and which are connected to an electric evaluation circuit.

The torsional elasticity of the connecting means may be easily adapted to the requirements by the shape and size of slots and other openings provided at the connecting means, which, as a rule, consists of steel or other material having the required elasticity. Even high torques with low torsion angles can be accurately determined accordingly.

The torque can be determined in that a switch is actuated to disconnect the drive unit when a specific limit value of the torque is reached. It is also possible to constantly measure and indicate the corresponding torque and the operator disconnects the device when the torque has reached a specific height.

If, for the determination of the torque, only a switching operation is to take place upon a reached limit value, it is possible, according to an advantageous embodiment of the invention, that the tube portion carries a switch member to actuate an electric switch. Switch and switch member are mounted on the tube portion so as to be axially offset relative to each other and the switch member acts on the switch via an arm. An exactly defined mounting of the torsionally elastic connecting means at the casing of the screw assembly is not necessary because not only the switch member but also the switch are fitted at the tube portion. However, such a defining mounting would be required if the switch element were secured to the torsionally elastic connecting means while the switch is attached at the casing, or vice versa. As a result of the mounting of both elements at the tube portion, the latter may be attached relatively loosely at the casing thus permitting its free adjustment under load and it is not subjected to additional clamping forces. Exact measurements require a loose coupling of the tube portion at the casing with the possible free adjustment under strain.

In a suitable further embodiment of the invention, the switch member in no-load condition closes the switch. Upon reacing the predetermined torsion angle, coupling between switch member and switch will be interrupted. In other words, the switch acts as a rest contact, or a contact which is normally closed and which is opened for disconnecting the drive unit. In case of a malfunction of the switch, the drive unit is disconnected accordingly.

In a preferred embodiment of the invention, a spring moving the arm towards the switch is provided while a stop limiting the arm movement and lifting the arm from the switch is mounted substantially antirotatingly relative to the casing or to the torsionally elastic connecting piece end facing the casing. While the retainer causes the formation of a torsional moment at the torsionally elastic connecting means, it is not by itself part of the system for the limitation of the torque. Its shape and dimension do not enter the result of measurement or the switch point. To permit to exchange the retainer, the connecting means end is provided with a toothed profile on which a ring of the retainer is guided to be displaceable longitudinally and non-rotatingly.

The invention is based on the idea of determining the torque by measuring a torsional movement which is as pure as possible. To avoid exposing the torsionally elastic connecting means to additional bending forces, which could falsify the result of measurement, the end of the connecting means is supported on a cylindrical extension of the casing.

According to a second variant of the invention, the connecting means as a torsionally elastic member has a substantially radial measuring flange the inner end of which is mounted rotatingly integral with the sleeve while its outer end is mounted rotatingly integral with the case and is displaceable longitudinally.

It is important that not both ends of the measuring flange are rigidly clamped, but at least its one end is displaceable longitudinally relative to the casing of the screw assembly. By this means, transverse forces and bending forces are prevented from being transmitted from the retainer to the measuring flange to falsify the measuring result. At least one end—preferably both ends—of the measuring flange should be self adjusting in axial direction. Strain gauges can be fitted at both front sides of the measuring flange to measure the torsional deformation and to show it in an indicating device.

With reference to the enclosed figures two embodiments of the invention will be now explained more closely hereinafter.

FIG. 6 is a side view, and partial section of a second embodiment of the power wrench, FIG. 7 is a schematic view of the electric evaluation circuit for the power wrench of FIG. 6.

Figure 1:
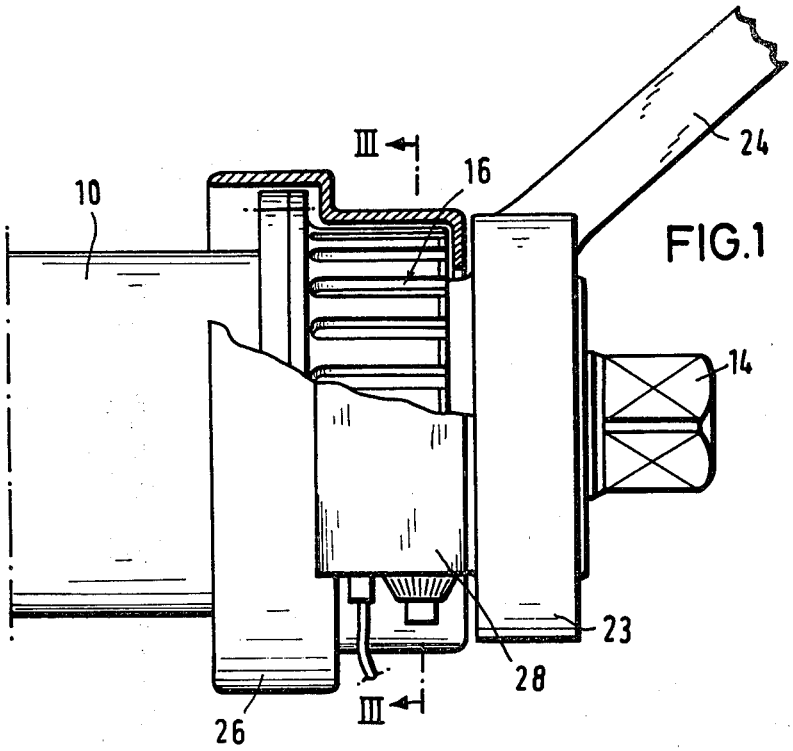
FIG. 1 is a partial plan view and section of a first embodiment of the power wrench.
Figure 3:
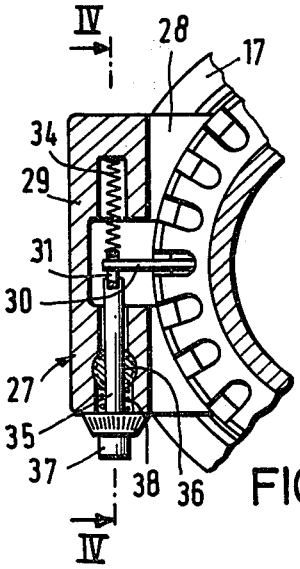
FIG. 3 is a section along line III—III of FIG. 1
Figure 4:
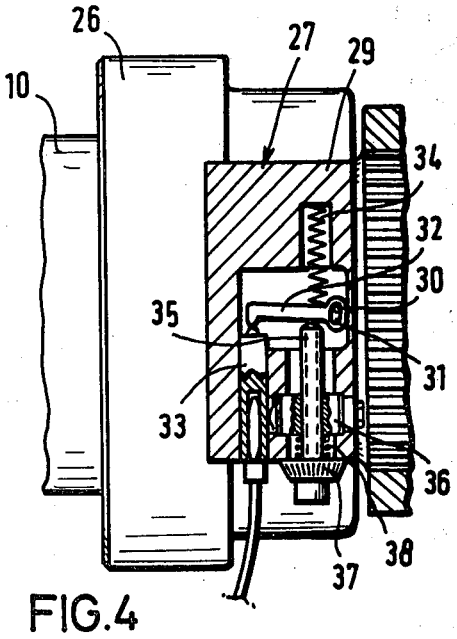
FIG. 4 is a section along line IV—IV of FIG. 3
Figure 2:
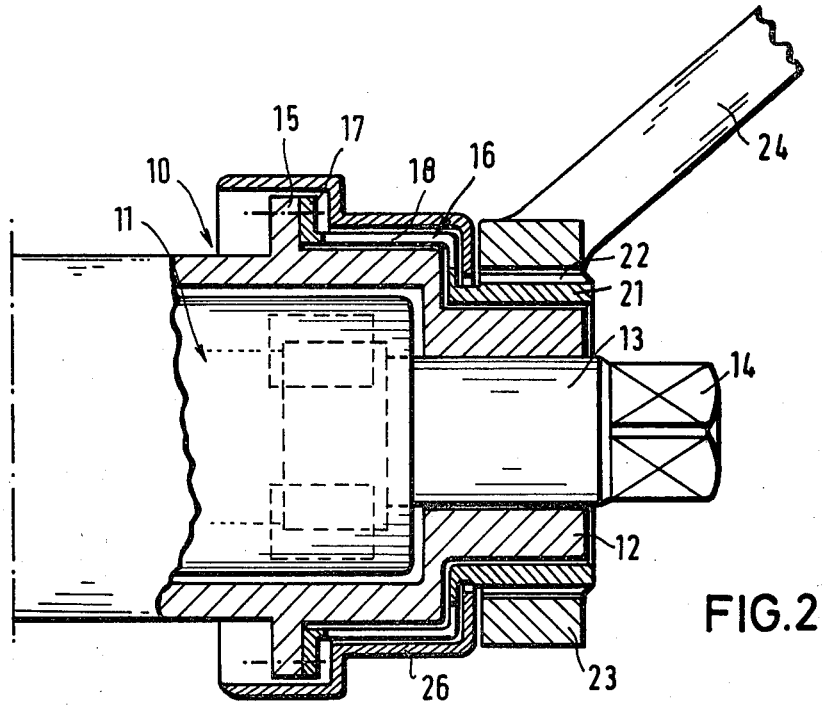
FIG. 2 is a longitudinal section of a power wrench according to FIG. 1

The power wrench illustrated in FIGS. 1-5 has a drive unit 11 housed in casing 10 and consisting for inst. of a hydraulic motor. The drive unit 11 is only intimated in FIG. 2 for a better survey, otherwise, it is not illustrated in greater details. The casing 10 is substantially cylindrical, and at its front end, it is provided with an axially projecting hollow extension 12 having a reduced diameter through which projects the output shaft 13 of the drive unit 11. At the outer end of the driving shaft 13, a square 14 serves for mounting a button die or the like.

Figure 5:
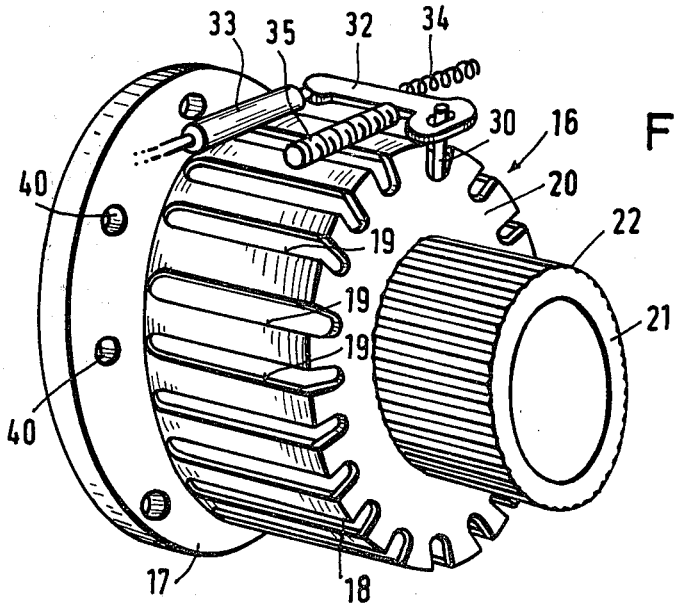
FIG. 5 is a perspective view of the torsionally elastic connecting piece with a schematic view of the switch and of the switch element of the power wrench according to FIG. 1.

The tube member 16 secured by an annular flange 17 to the annular flange 15 enclosing the casing 10 consists of a cage as illustrated in FIG. 5. Adjacent to the annular flange 17, there is fitted a cylindrical or torsional portion 18 having a wall which is interrupted by a great number of longitudinal parallel slots 19 which each continue to extend shortly in a front wall 20 directed inwardly. From the front wall 20, a sleeve 21 is projecting which is provided with teeth 22 or with longitudinal keyways. As obvious from FIG. 2, the sleeve 21 is supported on the extension 12 of the casing 10 while the cylindrical or torsional portion 18 of the tube element 16 encloses the end of the casing by forming a small annular interspace. The tube portion 16 is substantially fitted to the contour of the part of casing 10 surrounded by it.

A ring 23 is slipped over the teeth 22 at the front sleeve 12 of the tube element 16 and is provided with an internal toothing meshing with the toothing 22. The ring 23 forms part of the retainer 24 having a forwardly projecting inclined arm which can be mounted at a solid abutment to avoid rotating of the casing 10.

To protect the torsionally elastic region or casing 10 of the tube member 16, there is provided a protection cover 26 which overengages the annular flanges 15 and 17 and the cylindrical portion 18 of the tube member 16 and which is attached at the casing 10. The protection cover 26 is of no significance for the operation of the device.

Near the annular flange 17 at the cylindrical portion or part 18 of the tube member 16, an L-shaped block 27 is attached having one leg 28 which extends in parallel to the annular flange 17 and which is secured to the torsionally elastic part 18 in the direct vicinity of the annular flange 10, while the other leg 29 of block 27 freely projects forwardly to cover part 18.

At the end or front wall 20 of the tube element or member 16, a radially projecting switch element 30 is mounted in the form of a pin. Said switch element 30 protrudes through an elongated hole 31 of an arm 32 extending approximately in coaxial direction with the tubular member 16. The other end of the arm is actuating a switch 33 which is fixed at the block 27. By a spring 34 supported in the block 27, the arm 32 is pressed towards the switch 33.

A thread bolt 35 extends in parallel to the switch 33 and its fine thread passes through a screw 36 extending at a right angle to the thread bolt 5. By turning the screw 36, the position of the bolt 35 can be changed relative to the arm 32 thus permitting calibrating the torque limitation by turning the screw. The adjustment of the switch-off torque is effected by turning the thread bolt at the knob 37, which is supported by a spring 38 at the transverse bolt 36, to ensure an adjustment free of play. By turning the knob 37, the thread bolt 35 is advanced or withdrawn. Thus, the switch-off torque is set.

The knob 37 is provided with a scale allowing to read the adjusted switch-off torque.

The operation of the switching device is as follows:

If the drive unit 11 moves the output shaft 13, a torque is exerted on the non-illustrated screw head. The casing is retained in its position by the retainer 24 via the connecting piece 16. With an increasing torque, the torsionally elastic tube member 16 will be under an increasing torsional strain, i.e. its end adjacent the front wall 20 will be turned relative to the annular flange 17. However, block 27 will not change its position because it is secured to the rear end of the tube member 16. As a result, also the switch porton 30 and the thread bolt 35 maintain their position. First of all, the switch portion 30 commences to migrate in the elongated hole 31. After having passed it, the switch member 30 entrains the arm 32 until it abuts against the front end of the thread bolt 35. The arm 32 will be subsequently swivelled around the front end of the thread bolt 35 so that its one end will be lifted from switch 33 which, for lack of further pressure, is opened. Via an electronic circuit, switch 33 causes the actuation of a magnetic valve which disconnects the drive unit 11.

One end of the torsionally elastic tube element 16 is attached with its annular flange 17 at the annular flange 15 of the casing 10. To this effect, the two annular flanges 15, 17 are fitted with screw holes 40 (FIG. 5), having a diameter considerably greater than that of the screws passed therethrough which are supported on the annular flange 17 by (non-illustrated) washers. The screws are not completely tightened thus permitting a free adjustment of the annular flange 17 relative to the annular flange 15. By this means, additional material tensions are excluded and, as a result, the cylindrical part 18 of the tubular member 16 is subjected to a pure torsional strain.

In the embodiment of FIG. 6 the elements which, as to construction and function, are in agreement with the corresponding elements of the first embodiment are marked with the same reference numerals.

The output shaft 13 of the wrench assembly is enclosed by a sleeve 21 having a longitudinal toothing 22. Over said sleeve, ring 23 of the retainer 24 is loosely slipped. At the end of sleeve 21 abutting against the front end wall 50 of the casing 10, there is another toothing 51 having longitudinally extending teeth. Toothing 51 is meshing with the internal toothing of a measuring flange 52 which extends in parallel to the front wall 50 and which is movable in axial direction. The outer edge 53 of the measuring flange 52 is bent rearwardly and at its outer end, there is an internal toothing 54 which meshes with an outer toothing 55 of the front wall 50.

Thus, the measuring flange 52 can be freely adjusted relative to the front wall 50 of the casing 10 and relative to the sleeve 21 in axial direction, however, it is responsible for the rotarily elastic coupling of sleeve 21 with the casing 10. The front flange 52 being torsionally elastic, it is deformed during the transmission of a torque. On the side of the front flange 52 facing the front wall 50 strain gauges 56 interconnected according to FIG. 7 in a manner known per se to form a bridge circuit 57 are mounted. The bridge circuit 57 contains feed lines 58 and signal lines 59 connected with a control device 60, which comprises an indicating unit 61 and an adjustment knob 62 for the switch-off torque. An electric switch 63 in the control device 60 is responsible for the disconnection of the drive unit for the wrench assembly if the output voltage of the bridge circuit 57 exceeds at the signal lines 59 the limit value set at knob 62.

The measuring flange 52 according to FIG. 6 exclusively transmitting torsional forces but no transverse stresses and bending stresses, its suitability for the determination of the torque is excellent. Sleeve 21 encloses loosely the output shaft 13 rotating in it. There is no firm connection between sleeve 21 and the casing 10, but it is only prevented by non-illustrated holding means from dropping from the output shaft 13 (to the right side, according to FIG. 6). The rotary coupling of the sleeve 21 with the casing 10 is effected via the torsionally elastic measuring flange 52.

What is claimed is:

1. Apparatus comprising a drive unit for imparting torque to a output shaft, a casing housing said drive unit and being subject to such torque, an opening in said casing exposing said output shaft for connection to a driven member, a torsionally elastic tube member surrounding said casing and having axially opposite end portions, means for securing a first end portion of said tube member to said casing, means for preventing rotation of a second end portion and said tube member upon the operation of said drive unit whereby casing torque is tramsmitted to said first end portion while said second end portion is prevented from rotating, a switch element carried by said tube member at a portion thereof between said first and second end portions whereby torque transmitted to said first end portion is reflected by switch element movement, switch means for responding to switch element movement, and a switch arm for transmitting motion of said switch element to said switch means.

2. The apparatus as defined in claim 1 wherein said between portion is provided about a peripheral portion thereof with a plurality of elongated slots having axes generally parallel to a longitudinal axis of said output shaft.

3. The apparatus as defined in clam 1 wherein said switch means is normally closed in the absence of torque and opens when a predetermined torque is reached as reflected by movement of said switch element.

4. The apparatus as defined in claim 1 including spring means for biasing said switch arm in a direction toward said switch means and stop means for limiting the movement of said switch arm under the influence of said biasing means.

5. The apparatus as defined in claim 1 wherein said tube member surrounds said casing over part of the length of the casing adjacent said output shaft.

6. The apparatus as defined in claim 1 wherein said casing opening includes an elongated bore defined by a reduced cylindrical extension of said casing, and said second end portion is in external telescopic relationship to said cylindrical extension.

7. The apparatus as defined in claim 1 including means cooperative with said securing means for effecting circumferential adjustment of said tube member first end portion and said casing.

8. The apparatus as defined in claim 1 including means cooperative with said securing means for effecting circumferential adjustment of said tube member first end portion and said casing, said securing means including bolts passing through elongated openings in a flange of said tube member first end portion, and means for securing said bolts to said casing.

9. The apparatus as defined in claim 1 wherein said rotation preventing means is a disengageable connection between a retainer having a socket nonrotatably coupled to said second end portion.

10. The apparatus as defined in claim 1 wherein said switch element is disposed generally transverse to the axis of said output shaft, and said switch arm is disposed generally parallel to said output shaft axis.

11. The apparatus as defined in claim 1 wherein said switch element is disposed generally transverse to the axis of said output shaft, said switch arm is disposed generally parallel to said output shaft axis, said switch arm has opposite first and second ends, said switch element is in contact with said switch arm first end, and said switch means is actuated by said switch arm second end.

12. The apparatus as defined in claim 1 wherein said switch element is disposed generally transverse to the axis of said output shaft, said switch arm is disposed generally parallel to said output shaft axis, sad switch arm has opposite first and second ends, said switch element is in contact with said switch arm first end, said switch means is actuated by said switch arm second end, and said switch element is received in an opening of said switch arm first end.

13. The apparatus as defined in claim 1 wherein said switch element is disposed generally transverse to the axis of said output shaft, said switch arm is disposed generally parallel to said output shaft axis, said switch arm has opposite first and second ends, said switch element is in contact with said switch arm first end, said switch means is actuated by said switch arm second end, and said switch element and switch arm are disposed generally normal to each other.

14. The apparatus as defined in claim 1 wherein said switch element is disposed generally transverse to the axis of said output shaft, said switch arm is disposed generally parallel to said output shaft axis, said switch arm has opposite first and second ends, said switch element is in contact with said switch arm first end, said switch means is actuated by said switch arm second end, said switch element is received in an opening of said switch arm first end, and said switch element and switch arm are disposed generally normal to each other.

15. Apparatus comprising a drive unit for imparting torque to an output shaft, a casing housing said drive unit and being subject to such torque, an opening in said casing exposing said output shaft for connection to a driven member, a torsionally elastic tube member being at least in partial telescopic relationship to said casing and having axialy opposite end portions, means for nonrotatably axially slidably securing a first end portion of said tube member to said casing, means for preventing rotation of a second end portion of said tube member upon the operation of said drive unit whereby casing torque is transmitted to said first end portion while said second end portion is prevented from rotating, at least one strain gauge means carried by said tube member second end portion whereby torque transmitted to said first end portion is reflected by said strain gauge means, and electric circuit means for responding to an output of said strain gauge means reflecting the torque transmitted from said first end portion.

16. The apparatus as defined in claim 15 wherein said second end portion is connected to a sleeve in telescopic relationship to said output shaft.

17. The apparatus as defined in claim 15 wherein said second end portion is connected by toothing to toothing of a sleeve in telescopic relationship to said output shaft.

18. The apparatus as defined in claim 15 wherein said second end portion includes a radial flange carrying said strain gauge means.

19. The apparatus as defined in claim 17 wherein said second end portion includes a radial flange carrying said strain gauge means.

* * * * *